US005202604A

United States Patent [19]

Kweon

[11] Patent Number: 5,202,604

[45] Date of Patent: Apr. 13, 1993

[54] ELECTRON GUN FOR CATHODE RAY TUBE

[75] Inventor: Yong-geol Kweon, Seoul, Rep. of Korea

[73] Assignee: Samsung Electron Devices Co., Ltd., Kyunggi, Rep. of Korea

[21] Appl. No.: 520,217

[22] Filed: May 8, 1990

[51] Int. Cl.[5] ..... H01J 29/50

[52] U.S. Cl. ..... 313/414; 313/412

[58] Field of Search ..... 313/412, 414

[56] References Cited

U.S. PATENT DOCUMENTS

| | | | |
|---|---|---|---|
| 4,581,560 | 4/1986 | Shirai et al. | 313/414 |
| 4,599,534 | 7/1989 | Shirai et al. | 313/414 |
| 4,622,491 | 11/1989 | Izumida et al. | 313/414 |
| 4,812,706 | 3/1989 | Baudry et al. | 313/414 |
| 4,877,998 | 10/1989 | Maninger et al. | 313/414 |

FOREIGN PATENT DOCUMENTS

| | | | |
|---|---|---|---|
| 0225245 | 6/1987 | European Pat. Off. | 313/414 |
| 0108153 | 8/1980 | Japan | 313/414 |
| 0068848 | 4/1983 | Japan | 313/414 |

*Primary Examiner*—Donald J. Yusko
*Assistant Examiner*—N. D. Patel
*Attorney, Agent, or Firm*—Leydig, Voit & Mayer

[57] ABSTRACT

An electron gun for cathode ray tube, wherein the outer beam passing holes of the anode have an elongated slot which has a pair of opposingly facing semi-circular arcs having a radius as large as the radius of the outer beam passing holes of the focus electrode, and the innermost arc portions of the outer beam passing holes of the anode correspond with the arcs of the outer beam passing holes of the focus electrode. According to the present invention, degradation of picture quality due to differences in focusing voltages is prevented, and assembly of the electron gun with precision is rendered easier.

9 Claims, 2 Drawing Sheets

ELECTRON GUN FOR CATHODE RAY TUBE

INTRODUCTION

The present invention relates to an electron gun for a cathode ray tube, and particularly to a self convergence in-line type electron gun for cathode ray tube.

BACKGROUND OF THE INVENTION

An in-line type electron gun is constituted such that its cathode as a source of electron beams are positioned on a common plane, and a converging means is provided to converge the electron beams generated from the cathodes into a small spot on the screen of cathode ray tube. Such a converging means is provided in a main lens means which comprises a single main focus lens. Such a converging means is constituted as schematically illustrated in FIGS. 1, 2 and 3, and explained in U.S. Pat. No. 3,772,554.

As shown in FIGS. 1 and 2, such a single lens type electron gun comprises: cathodes K for emitting thermal electrons; a control grid G1 and a screen grid G2 for transforming emitted thermal electrons into electron beams; and a focus electrode G3 for focusing transformed electron beams and an anode G4 for accelerating and refocusing focused electron beams. In such an electron gun, the converging means is constituted such that outer beam passing holes 4Ha' of anode G4 are positioned outwardly enlarged relative to beam outgoing outer beam passing holes 3Ha of focus electrode G3.

Since such a converging means has upstream and downstream beam passing holes eccentrically aligned with respect to one another, there are several limitations in designing such a converging means.

As shown in FIG. 3, the diameters of outer beam passing holes 4Ha' of anode G4 are designed to be greater than those of outer beam passing holes 3Ha of focus electrode G3. However, looking from the side of the screen of cathode ray tube opposite cathodes K, outer beam passing holes 3Ha should not be hidden behind, but should be exposed in its entirety inside outer beam passing holes 4Ha'. If outer beam passing holes 3Ha of focus electrode G3 are hidden behind outer beam passing holes 4Ha' of anode G4, a straight guide rod (not shown) cannot be inserted.

Therefore, generally, as shown in FIG. 3, the innermost circumference of outer beam passing holes 4Ha' is made to be tangent with that of outer beam passing holes 3Ha. Thus, the diameters of outer beam passing holes 3Ha should be smaller than those of outer beam passing holes 4Ha'.

However, if outer beam passing holes 4Ha' are enlarged for ease of assembly of the electrodes, then there arise discrepancies between the electric fields of outer beam passing holes 3Ha and 4Ha' and middle beam passing holes 3Hb and 4Hb, resulting in differences in characteristics of the R, G, B beam between the middle electron beam and outer electron beams, which in turn result in degradations of picture quality.

SUMMARY OF THE INVENTION

Therefore, it is the object of the present invention to provide an improved electron gun for cathode ray tube, in which degradation of picture quality due to focus voltage differences of the main focus lens does not occur.

In achieving the above object, the electron gun according to the present invention is constituted such that the outer beam passing holes of the anode are positioned outwardly enlarged relative to the outer beam passing holes of the focus electrodes, so that the focus electrode and anode, which constitute the main lens means, form asymmetric electric fields, wherein the outer beam passing holes of the anode have a shape of an elongated slot. The elongated slot has arcs facing one another and the radius of each arc is substantially equal to that of the outer beam passing holes of the focus electrode. Further, the innermost arc portions of the outer beam passing holes of the anode are substantially axially aligned with the innermost arc portions of the outer beam passing holes of the focus electrode.

In the electron gun of the present invention, eccentrical alignments between the outer beam passing holes of the focus electrode and anode, which together constitute the main lens means, are permitted for converging electron beams generated from the cathodes. Further, differences between the cross sectional areas of the outer beam passing holes and the middle beam passing hole of the anode is reduced, which in turn reduces differences in characteristics between the electron beams of the outer and middle beam passing holes, thereby improving picture quality.

BRIEF DESCRIPTION OF THE DRAWINGS

The above object and other advantages of the present invention will become more apparent by describing in detail the preferred embodiment of the present invention with reference to the attached drawing.

DESCRIPTION OF THE PREFERRED EMBODIMENT

Figure 1:
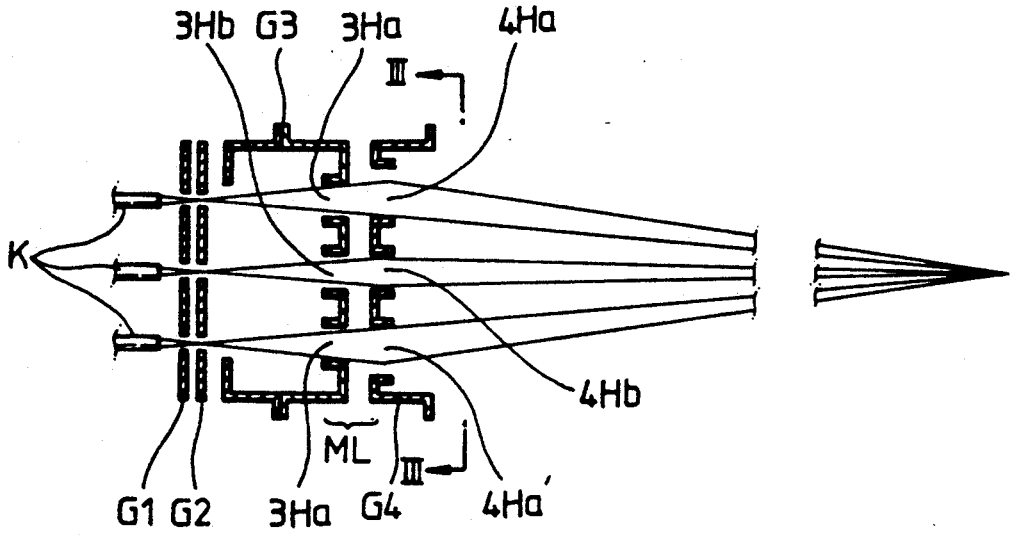
FIG. 1 (PRIOR ART)
FIG. 1 is a schematical sectional view of a conventional in-line type electron gun having an asymmetrical main lens means ML producing eccentric electric fields.
Figure 2:
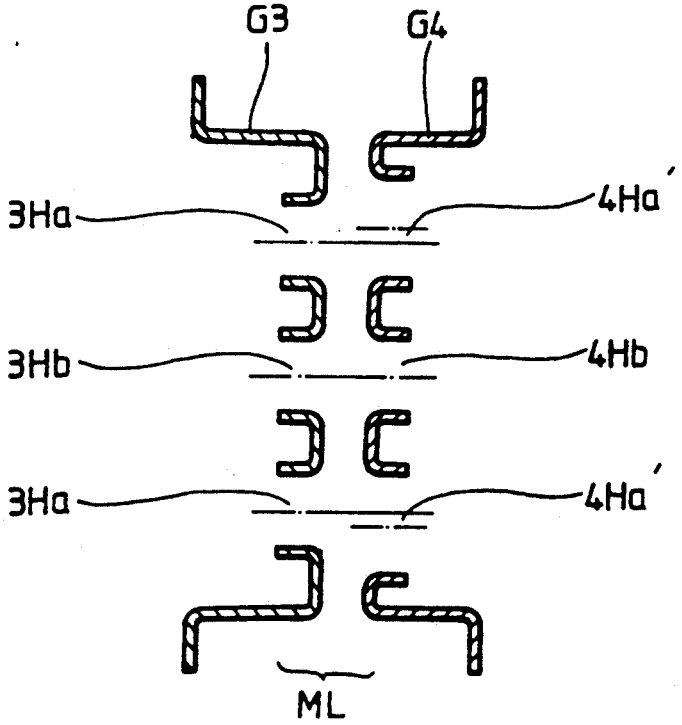
FIG. 2 (PRIOR ART)
FIG. 2 is an enlarged view of the main lens means ML of the electron gun of FIG. 1.
Figure 3:
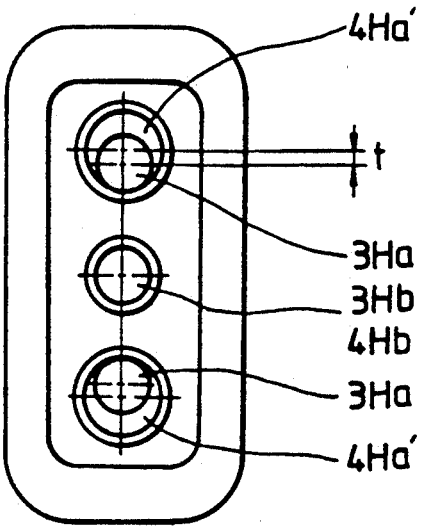
FIG. 3 (PRIOR ART)
FIG. 3 is a sectional view taken along the line III—III of FIG. 1.

The self converging in-line type electron gun according to the present invention includes the general components of the conventional electron gun of FIG. 1, i.e., three cathodes arranged in-line, a control grid and a screen grid for transforming thermal electrons of the cathodes into electron beams, and a focus electrode for focusing transformed electron beams and an anode for accelerating the beams and refocusing focused electron beams. The focus electrode and anode include an electron beam converging means which is a characteristic feature of the present invention.

Figure 4:
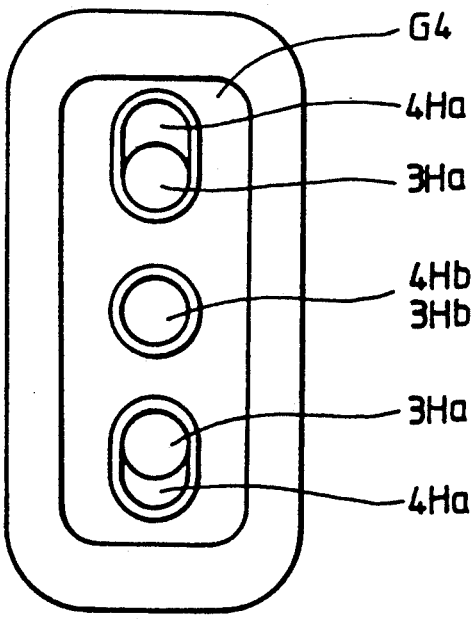
FIG. 4 illustrates the relationship between the outer beam passing holes of the focus electrode and the anode for the electron gun of the present invention.

FIG. 4 shows a plan view of the electron gun of the present invention, looking from the screen side of anode G4 into focus electrode G3. Anode G4 includes elongated upper and lower outer beams passing holes 4Ha spaced from and facing one another, and a circular middle beam passing hole 4Hb disposed therebetween. The innermost arc portion of each outer beam passing hole 4Ha, which is disposed adjacent middle beam passing hole 4Hb, conforms with a respective portion of the innermost circumference of a respective outer beam passing hole 3Ha of focus electrode G3.

A middle beam passing hole 3Hb of focus electrode G3 has a substantially same diameter as middle beam passing hole 4Hb of anode G4 and is concentrically positioned therein.

Now the relationship between outer beam passing holes 3Ha and 4Ha will be described below.

Figure 5:
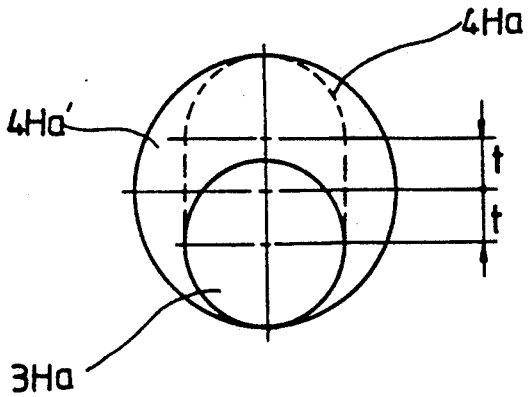
FIG. 5 extractively illustrates the relationship between the outer beam passing holes of the focus electrode and the anode for the electron gun according to the present invention.

FIG. 5 demonstrates the difference between the conventional outer beam passing holes and the outer beam passing holes of the present invention. The solid-lined inner circle of a smaller diameter represents outer beam passing hole 3Ha of focus electrode G3. The solid-lined outer circle of a large diameter represents outer beam passing hole 4Ha' of the conventional anode. Outer beam passing hole 4Ha of anode G4 according to the present invention is shown by a dotted line, and is constituted such that two assumptive circles having a radius as large as that of beam passing hole 3Ha of focus electrode G3 are continuously overlappingly punched with an inter-center distance between the outermost circles which is smaller than the diameter of the outer beam passing holes 3Ha.

That is, according to the present invention, outer beam passing holes 3Ha and 4Ha of the focus electrode and the anode, respectively, are positioned such that an eccentricity of a predetermined distance is allowed between holes 3Ha and 4Ha, while the cross sectional area of outer beam passing holes 4Ha of anode G4 is kept to a minimum.

Particularly, the innermost arc portion of outer beam passing holes 3Ha and 4Ha substantially corresponds to and overlap one another. Therefore, the guide rod can be inserted to be in contact with an evenly aligned innermost arc portions of outer beam passing holes 3Ha and 4Ha, thereby facilitating assembly of the electron gun with precision.

Further, in the electron gun according to the present invention, the cross sectional areas between middle beam passing hole 4Ha and outer beam passing hole 4Ha of anode G4 are kept to a minimum, to keep differences in focusing voltages to a minimum, thereby minimizing degradation of picture quality due to differences in focusing voltages.

What is claimed is:

1. A main lens of an electron gun for a cathode ray tube, comprising:

a focus electrode having two outer beam passing holes of a selected shape each outer beam passing hole having a radius; and an anode disposed adjacent said focus electrode, said anode including two outer beam passing holes of a different shape from the outer beam passing holes of said focus electrode, each outer beam passing hole of said anode having an elongated slot with semi-circular end arcs facing one another, the radius of each semi-circular end arc being substantially identical to the radius of a respective one of the two outer beam passing holes of the focus electrode.

2. A main lens of an electron gun for a cathode ray tube, comprising:

a focus electrode having one or more circular outer beam passing holes; and an anode disposed adjacent said focus electrode, said anode including one or more outer beam passing holes of a different shape from the outer beam passing holes of said focus electrode, each outer beam passing hole of said anode having an elongated slot with semi-circular end arcs facing one another, the radius of each semi-circular end arc being substantially identical to the radius of a respective one of the one or more outer beam passing holes of the focus electrode.

3. The electron gun of claim 2, wherein each semi-circular end arc of the outer beam passing holes of the anode is aligned with a respective outer beam passing hole of the focus electrode.

4. The electron gun of claim 2, wherein said anode includes at least two outer beam passing holes spaced from one another and each having an elongated slot with semi-circular end arcs facing one another, further comprising a middle beam passing hole disposed between the two beam incoming outer beam passing holes and spaced therefrom, the cross sectional area between the middle beam passing hole and each one of the two outer beam passing holes being kept to a minimum to minimize differences in focusing voltages.

5. The electron gun of claim 3, wherein one of the one or more outer beam passing holes of the focus electrode is coaxially disposed with respect to one of the one or more outer beam passing holes of the anode.

6. The electron gun of claim 2, wherein a portion of each semi-circular end arc of the outer beam passing hole of the anode is in parallel alignment with a portion of the circumference of a respective outer beam passing hole of the focus electrode.

7. A main lens of an electron gun for a cathode ray tube, comprising:

a focus electrode having two outer beam passing holes; and an anode disposed adjacent said focus electrode, said anode including two outer beam passing holes each defined by two continuously overlapping assumptive circles having a radius as large as a radius of the outer beam passing holes of said focus electrode and having an inter-center distance between the two circles which is smaller than the diameter of the outer beam passing holes of said focus electrode.

8. The main lens of claim 7 wherein said anode includes a circular middle beam passing hole.

9. The main lens of claim 7 wherein a distance between vertices of the outer beam passing holes of said anode is greater than a distance between the vertices of the outer beam passing holes of said electrode.

* * * * *

UNITED STATES PATENT AND TRADEMARK OFFICE

CERTIFICATE OF CORRECTION

PATENT NO. : 5,202,604

DATED : April 13, 1993

INVENTOR(S) : Yong-geol Kweon

It is certified that error appears in the above-identified patent and that said Letters Patent is hereby corrected as shown below:

Title page, item [73], Assignee, change "Kyunggi, Rep. of Korea" to --Kyunggi-do, Rep. of Korea--.

Claim 3, col. 4, line 18, change "holes" to --hole--.

Claim 4, col. 4, line 26, delete "beam incoming".

Signed and Sealed this

Eleventh Day of January, 1994

Bruce Lehman

*Attest:*

BRUCE LEHMAN

*Attesting Officer*

*Commissioner of Patents and Trademarks*